US005613986A

United States Patent [19]

Bessey et al.

[11] Patent Number: 5,613,986

[45] Date of Patent: Mar. 25, 1997

[54] SYNTHETIC FIBER DYEING PROCESS

[75] Inventors: William E. Bessey, Charlotte, N.C.; Joseph DaSilva, West Warwick, R.I.

[73] Assignee: Hoechst Celanese Corporation, Somerville, N.J.

[21] Appl. No.: 651,437

[22] Filed: May 22, 1996

Related U.S. Application Data

[63] Continuation of Ser. No. 376,471, Jan. 20, 1995, abandoned, which is a continuation of Ser. No. 62,877, May 17, 1993, abandoned.

[51] Int. Cl.[6] ..... D06D 7/00

[52] U.S. Cl. ..... 8/489; 8/512; 8/516; 8/922; 8/924; 8/932; 8/933

[58] Field of Search ..... 8/489, 506, 516, 8/920, 922, 924, 932, 933, 512

[56] References Cited

U.S. PATENT DOCUMENTS

| | | | |
|---|---|---|---|
| 2,663,612 | 12/1950 | Gibson | 8/34 |
| 3,241,906 | 3/1966 | Smith et al. | 8/55 |
| 3,367,150 | 2/1968 | Smith et al. | 68/5 |
| 3,434,189 | 8/1966 | Buck et al. | 8/489 |
| 3,512,913 | 5/1970 | Day et al. | 8/489 |
| 3,871,819 | 3/1975 | Greer | 8/130.1 |
| 3,944,386 | 3/1976 | Wilkinson | 8/177 R |
| 4,066,396 | 1/1978 | Wolf et al. | 8/178 A |
| 4,265,632 | 5/1981 | Papenfuhs et al. | 8/489 |
| 4,299,015 | 11/1981 | Marcus et al. | 8/489 |
| 4,681,594 | 7/1987 | Chion et al. | 8/489 |

FOREIGN PATENT DOCUMENTS

| | | |
|---|---|---|
| 1094725 | 12/1967 | United Kingdom . |
| 2023193 | 12/1979 | United Kingdom . |

*Primary Examiner*—Paul Lieberman
*Assistant Examiner*—Caroline L. Dusheck
*Attorney, Agent, or Firm*—Philip P. McCann

[57] ABSTRACT

The invention is a method of producing a melt spun synthetic polymeric filament which has the superior deep dyeability thereof. The method includes the steps of application of a dye dispersed in water to the filaments during the drawing of the filament, and heat setting the surface dyed filaments to uniformly diffuse the dye throughout the total cross section of the filaments.

2 Claims, No Drawings

SYNTHETIC FIBER DYEING PROCESS

This is a continuation of application Ser. No. 08/376,471 filed on Jan. 20, 1995, now abandoned, which is a continuation of Ser. No. 08/062,877 filed on May 17, 1993, now abandoned.

BACKGROUND OF THE INVENTION

1. Field of the Invention

The present invention relates to a novel process for dyeing melt spun synthetic polymeric filaments. The process of the present invention is used to produce a highly oriented filament having a uniform dyed cross-section.

2. Prior Art

It is well known in the art that dyeing melt spun synthetic polymer filament is affected by numerous variables including drawing and heat treating of the filaments as well as the selected dyeing process. Each of these processes are interrelated and necessary for production of melt spun synthetic polymeric filaments.

Generally it is known to produce melt spun synthetic polymeric filaments by the steps of melt spinning the polymer to form filaments, drawing the filaments to obtain desired tensile and thermal properties, annealing the filaments, crimping and drying the filaments. It is well known that annealing of the filaments may be combined with the drying the filaments at elevated temperatures.

Drawing occurs when the melt spun filaments are elongated. In particular, drawing is defined as the stretching of continuous filament yarn or tow to increase the average axial alignment of the polymer molecules of the filament resulting in improved tensile and thermal properties. Such yarns are termed drawn or tensilized yarns.

During the drawing process the polymer molecules in the filament or fibers become oriented and more closely packed generally referred to as orientation in the filaments. This increases the specific strength and modulus of the filaments. The actual amount of drawing necessary is determined by the amount of orientation developed in the spinning process and also by the level of tenacity desired in the final product. For example, in U.S. Pat. No. 3,216,187, Chantry et al describe a polyester process designed to minimize orientation in the melt spun polyester yarn and then the use of high draw ratios, e.g. 6.7:1, to obtain a very strong yarn for use in, for example, reinforcing automobile tires. Conversely, U.S. Pat. No. 4,134,882 describes spinning at very high stresses to maximize spun yarn birefringence or spun molecular orientation and thereby minimize or eliminate the drawing step.

Generally, drawing is done at a temperature of the tow from about 60° C. to about 80° C. i.e. at temperatures near the glass transition temperature of the polymer.

Further improvements in yarn strength and shrinkage characteristics result from annealing the drawn yarns at temperatures significantly above their glass transition temperatures. Generally, annealing of polyester filaments occurs immediately subsequent to the drawing process at temperatures from about 160° C.–200° C. for a short period of time. Annealing the filament further increases the density of the filament and stabilizes it against subsequent shrinkage when subjected to heat. Such heat treatment is generally referred to as thermal crystallization of the filament.

Two forms of annealing are commonly practiced. If high tensile properties are desired, the annealing is carried out at a predetermined fixed length. In continuous processes, this is usually accomplished by using a series of rolls operating at fixed speeds. The heat may be applied either by heating the roll surfaces or installing another heating device such as a hot plate or a hot air oven between the rolls.

A second form, annealing in a free shrink condition will, in general, result in lower final shrinkage values than fixed length annealing but will also reduce the tenacity and modulus. In commercial practice, free to shrink annealing is usually accomplished by loosely depositing the filaments onto a conveyor belt which passes through a hot air oven.

As produced, melt spun filaments and fibers are smooth, essentially one dimensional and uniform in character. In many applications this smoothness and one dimensional character are undesirable. Consequently, the filaments are subjected to a bulking process. Bulking may be accomplished, for example, by steam or air jets, by stuffer boxes, by edge treatments, or by false twist texturing. Texturing is often done at elevated temperatures to provide more durable bulk.

Subsequent to bulking, the filaments are dried. However, it is known in the art that the annealing stage may be replaced with heat setting in the drying stage. If annealing is omitted between drawing and bulking, then the filaments are generally dried and heat set at temperatures greater than the glass transition temperature for a time of 5 minutes or more.

Dyeing processes are based on the specific melt spun synthetic filament. Dyeing may be accomplished by application of the dye to the spun filaments or incorporation of the dye into the polymer melt prior to spinning. The process includes application of the dye plus suitable processes to affix the dye to the synthetic filament.

Polyesters are most often dyed with disperse dyes, also known as acetate dyes. These dyes are virtually insoluble in water but may be dispersed as very fine particles. They are sold in finely divided form together with a dispersing agent and fillers. Typically the actual dye represents only about 20% of the commercial dye powder. In commercial practice, these dyes are applied to the fibers by aqueous dispersions. The dispersing agents and fillers are then washed off and discarded.

The dyeing process contains several steps and generally requires several hours to complete. The steps typically include pre scour, actual dyeing and post scouring steps. Generally, not all of the dye enters the fiber. Some remains in the dye bath and some remains on the fiber surface. Several washing and scouring steps may be required to remove surface dye and the dye assist chemicals. Each step in the dyeing process generates significant quantities of waste water.

The dyeing process may be enhanced by the use of pressure or high temperature dyeing. The dyeing process may be quickened by higher dyeing temperatures. High temperature dyeing is accomplished using super-atmospheric pressures to allow dyeing temperatures, for example, for polyester at about 130° C. Pressure dyeing requires specialized pressure containment vessels and adds significantly to the energy costs of dyeing.

It is also known to produce colored filament by adding selected thermally stable pigments directly to the polymer melt and spinning filaments which are already colored or pigmented with the thermally stable pigments. This process is variously called melt coloration, spin dyeing or solution dyeing. It is now used on a large scale for filaments. Although care must be taken to minimize pigment thermal degradation and off gassing during spinning, mass coloration is more suitable to the environment than traditional dyeing.

However, its primary disadvantage is that large batches of filaments have to be produced and the range of colors which can be commercially available is limited. Also, color matching and color control in the melt spun coloration can be extremely tedious and the selection of acceptable pigments is much smaller than the selection of disperse dyes.

Various dyeing processes used before the drawing of the filament are known. For example, U.S. Pat. No. 3,241,906 discloses a dyeing step prior to the drawing process so that both coloring and strengthening of the filaments can be performed in one continuous operation. Specifically, the process is directed to applying a dye dispersed, without dispersing agents or other diluents, in an organic, substantially nonaqueous, hot solvent to undrawn melt spun filaments under conditions such that the penetration of the dye into the filaments is 60% of the cross-sectional area or more. The dye is applied at temperatures up to 150° C. for a short time, preferably less than 30 seconds, using an organic solvent which dissolves the dye but does not cause embrittlement of the filaments. This is followed by drawing of the filaments 3 to 6 times their length.

Combining conventional aqueous dyeing systems with conventional drawing systems has so far not proven to be commercially viable. The primary reason is that dyeing is a diffusion controlled process and sufficient times are not available during drawing to permit completion of the diffusion. Attempts have been made to accelerate diffusion. British Patent Specification 1,094,725 discloses a process for the continuous dyeing of polyester filaments wherein a dispersion of dyestuff is applied to the stretched or unstretched filaments which are then drawn if undrawn, dried and allowed to shrink by at least 10% at a temperature within 50° C. of its melting point. After the dye is applied, the material is dried at 50° to 80° C. and then shrunk at a much higher temperature. The rate of dye diffusion is considerably enhanced during the high temperature relaxation step and an acceptable level of dye penetration is achieved. After shrinkage, the yarn may be redrawn to re-establish the desired level of strength.

This process has the disadvantage that several additional, non-standard steps have been added to the drawing process requiring new drawline designs. In particular, in order to achieve the high shrinkages required by this process the draw tension must be released before the yarn is heated. If the heat is applied first the yarn will anneal and the requisite shrinkages can not be obtained. Traditional drawing equipment is not configured with this capability. Also, several post draw washing and scouring steps are required to remove excess dye and dye assist chemicals clearly showing that the dyeing was still not complete.

A process to uniformly dye synthetic fibers is disclosed in U.S. Pat. No. 2,663,612. A process includes impregnating the fiber by padding or printing with an aqueous suspension of the dye, drying the impregnated fiber and then giving it a dry heat treatment at a temperature of between 180° C. and 230° C. for a brief interval of time, 5 to 60 seconds.

It is an aim or aspect of the present invention to provide a process for continuous dyeing of synthetic filaments resulting in a drawn filament having essentially 100% cross-sectional dye uptake.

SUMMARY OF THE INVENTION

The present invention provides a unique process of preparing a melt spun synthetic filament by effectively sequencing the steps of application of the dye, drawing the filaments, and heat setting the filaments.

In particular, the present invention is a process for making synthetic filaments wherein a dye dispersed in water is applied to the filaments prior to or during the drawing of the filaments. The filaments may then be treated for a short time period at a high temperature to anneal and surface dye the filaments. Next the filaments are heatset for a longer time at a lower temperature during in which the dye diffuses fully through the fiber cross section.

The present invention is a method for dyeing of filaments melt spun from synthetic polymers, including the steps of:

1) application of a dye to filaments prior to or during the drawing step of the filaments;
2) drawing the filaments; and
3) heat setting said surface dyed filaments under such conditions of temperature and time to uniformly diffuse the dye throughout the total cross-section of the filament.

The present invention also comprises a polyester product made by the above-mentioned process.

DESCRIPTION OF THE PREFERRED EMBODIMENTS

In the following detailed description there is described a preferred embodiment of the invention. It will be recognized that although specific terms may be used in describing the preferred embodiment, these are used in the descriptive sense and are not generic, and are used for the purposes of description and not of limitation. The invention is capable of numerous changes and variations within the spirit and scope of the teachings herein, as will be apparent to one skilled in the art.

The filamentary component of the present invention may comprise a variety of synthetic polymers such as polyesters and polyamides. The term filament is used herein to cover both the filament as well as fibers produced therefrom. In the preferred embodiment of the invention, the filament component is polyester including poly(ethylene terephthalate), poly(trimethylene terephthalate), poly(tetramethylene terephthalate) and their copolymers.

As is known to those familiar with the commercial production of polyester, the polyester polymer can be formed from a starting mixture of terephthalic acid and ethylene glycol, or from dimethyl terephthalate and ethylene glycol. The polyester may be manufactured using batch process or a continuous process. The reaction proceeds through the well known steps of esterification and condensation to form polyethylene terephthalate (PET). A number of catalysts or other additives have been found to be useful in promoting either the esterification or condensation reactions, or in adding certain properties to the polyester.

The polyester polymer is formed as a viscous liquid which is forced through a spinneret head to form individual filaments, a process generally referred to in the ark as spinning or as melt spun. The spun filaments are subsequently dyed, drawn, and heat-set. They may also be crimped, and cut to form staple. Appropriate lubricating finishes are added in a conventional manner.

Dyeing begins with selection of a suitable dye. Synthetic dyes suitable for use in the dispersions of this invention are insoluble or sparingly water-soluble dyes. Such dyes are for example sulfur dyes, pigments or vat dyes, but are preferably disperse dyes which belong chemically to a wide range of classes.

The disperse dyes are, for example, nitro, aminoketone, ketoneimine, methene, diphenylamine, quinoline, nitroaniline, benzimidazole, xanthene, oxazine, aminonaphthoquinone, coumarin, or pyridone which do not contain solubilizing carboxylic acid and/or sulfonic acid groups, and are particularly anthraquinone and azo dyes such as monoazo or polyazo dyes. These classes represent only a few examples of the variety of dyes which may be used in this invention and should in no way be construed as a limitation to the applicability of the present invention.

In addition, it is also possible in the process of this invention to apply mixtures of dyes. Such dye mixtures may suitably be combinations of dyes which are insoluble or sparingly soluble in water.

Commercially available disperse dyes have been shown to perform adequately in this invention. However, these dyes are formulated so as to contain only 10–50% pure dye. Consequently, they tend to leave large quantities of Water soluble dispersants on the fiber surface particularly when dark shades are produced. Surface deposition can be significantly reduced by reformulating the dye to contain a minimum of extraneous materials. This significantly reduces unwanted deposits. Such dyes can be prepared by dispersing the aqueous dye in dispersions including dispersants, defoamers, biocides, thickeners and carriers. The ratio of dye to dispersant should be maintained as high as possible, preferably greater than 3:1.

Subsequent to melt spinning, a dye dispersed in water is applied to the filaments prior to or during the drawing of the filaments. The application of the dye can be accomplished in many manners, eg padding, spraying, immersion, etc. For low filament counts, <1000, an application similar to that used to apply metered spin finishes works well. The concentration of the dye in the dispersion and the level of dispersion added can both be chosen for convenience provided the equilibrium moisture of the threadline under draw tension is not exceeded. In this case, the achieved level of dye uptake is simply the quantity of dye metered onto the threadline. If the equilibrium moisture level is exceeded, dye will be lost through dripping and deposition on surfaces and control of the dye level will be lost.

For larger filament counts, >1000, it becomes progressively more difficult to uniformly distribute the dye from filament to filament and along the filament bundle. In this case we have found it best to super-saturate the tow band and mechanically remove any excess dispersion. In this case achieved dye level is equal to the product of the saturation moisture level and the concentration of the dye in the dispersion. Dye diffusion rates do not impact dye levels in this process and consequently barre' is eliminated.

The filaments are next drawn. Drawing of the filaments is directed to the orientation of the polymer molecules within the filaments. One process to draw the filaments is by speed differential between two sets of rollers through which the filament passes. In this case, the first rollers have a speed designated as 1 and the second rollers have a speed greater than that of the first rollers. This speed differential between the rollers causes the filament to stretch. This stretching is called drawing. Hence, if the second set of rollers have a rotating speed 4 times that of the first rollers, the draw will be about 4:1.

It is known to those familiar with the nature of polymers, that orientation refers to a somewhat ordered condition in which the long polymeric molecules are in a greater degree of linear relationship to one another and with the fiber axis, but are not in the lattice-site and bonding relationships with one another that would define a crystal lattice. All other factors remaining equal, increased orientation tends to result in increased shrinkage, as application of heat leads to the natural increase in entropy or randomization of the otherwise oriented molecules. The randomization tends to be reflected as a decreasing fiber length as a linearly oriented molecules move into less linear relations with one another. Shrinkage can be greatly reduced by annealing and developing a stabilizing crystalline structure within the oriented fiber.

As is further known to those familiar with such processes, the drawing conditions affect the orientation of the polymer, and therefore, a number of the properties which relate to the orientation such as tenacity, modulus, dyeability and shrinkage.

As used herein, the drawing conditions include the draw ratio and draw temperature. Draw ratio is defined as the ratio of the final length in which the drawn filament is passed on to other process such as heat setting to the initial length of the filament prior to drawing. Other variables aside, a greater draw ratio increases the orientation of the polymer forming the filament, thereby increasing the tensile properties and the shrinkage of the resulting fiber, but decreasing the dyeability. A lower draw ratio decreases the tensile properties and shrinkage of the fiber and increases the dyeability.

The natural draw ratio for a fiber is the draw ratio at which the fiber will no longer "neck". Alternatively, this can be expressed as the amount of draw required to end necking and begin strain hardening of a drawn fiber. As is known to those familiar with filament processes, when a filament is first drawn, it forms one or more drawn and undrawn portions in which the transition regions are referred to as the necks. At the natural draw ratio, however, all of the filament is in the drawn state and the neck and the undrawn portions disappear. The filament obtains a uniform cross section which then decreases uniformly (rather than in necks in undrawn portions) as the fiber is drawn further. The natural draw ratio reflects the degree of orientation of the undrawn spun fiber with a lower natural draw ratio reflecting a higher degree of orientation, and vice versa.

The natural draw ratio is measured by placing a length of spun tow into clamps mounted on an Instron tensile tester, stretching the bundle until break. The natural draw ratio is measured from the start of the stretching to the onset of strain hardening. Draw ratios in the present invention may be from about 1.5:1 to about 8:1 preferably from about 2:1 to about 4:1.

Drawing temperature is defined as the temperature at which drawing takes place. Operationally this is usually taken as the temperature of the drawing medium used to induce the spun filament to yield. Typical examples of a medium include steam, liquid and heated rolls. Generally, the drawing temperatures is from about 60° C. to about 90° C. If the draw temperature is too high, the filament may either fail or crystallize in the unoriented state and become undrawable. If the temperature is too low the stress at the neck may exceed the fiber strength and the fiber will break. These relationships hold true for the polyester homopolymers as well as the copolymers, so that the draw ratio and draw temperature can generally be selected to give desired tensiles within a given range defined by the nature of the polymer or copolymer.

Following drawing, the filament may be annealed at a filament temperature and time that substantially all water evaporates from the surface of the filaments and leaving the dye on the filament surface. The total time required to achieve this depends on many factors such as the method of heating, fiber bundle thickness, specific surface area of filaments and total level of dye applied. Preferred temperature for polyester is greater than 75° C., from about 140° C. to about 240° C. for up to 10 seconds preferably from about 190° C. to about 210° C. for about 5 seconds. Annealing temperature is defined as the temperature of the filaments at which annealing takes place. Actual filament temperatures can be determined via infrared thermometry, surface temperature measurements or after the fact thermal characterization. Accurate temperatures can also be calculated using classical heat transfer methodology. The higher the annealing temperature, the higher the crystallinity and the lower the subsequent shrinkage. Conversely, the lower the temperature the less crystallinity and the more shrinkage.

The annealing temperatures are raised high enough to set the desired tensile properties in the polymer filament and to maintain the shrinkage of the polymer filament substantially the same as the shrinkage of the non-enhanced polyester filament.

Subsequent to the drawing and annealing processes the fibers may be rinsed to remove any residual unfixed dye and dye dispersants and the fibers may be crimped to provide improved aesthetics.

Subsequent to rinsing and crimping, the filaments are heated under such conditions of temperature and time to uniformly diffuse the aqueous insoluble dye throughout the total cross-section of the filament. Expeditiously, this heat treatment is accomplished in a continuous treatment hot air oven. Temperature range for the heating zone is from about 100° C. to about 180° C. The time in residence of the filaments in the heating zone depends on the thickness of the material and the chemical composition of the polyester and on the type of heat transfer and on the amount of dye. It has been found in the present case that about at least 10 minutes is required in a forced convection hot air oven to assure uniform diffusion of the aqueous insoluble dye throughout the total cross section of the filament. Preferred heat setting temperatures are from about 160° C. to 180° C., and a preferred heat setting time is about 10 minutes. It will be obvious to those skilled in the art that lower temperatures and darker shades will generally require more time.

By this treatment the dyestuff diffuses into the interior of the filaments to improve the dye characteristics of the filaments such uniformity, light and wash fastness. All of the above described methods for carrying out the process of the present invention yield uniformly dyed filaments or tows of polyester material.

There are many advantages of the present invention versus conventional dyeing. The entire, costly, conventional dyeing process with its pre and post dye washes is eliminated as are the large quantities of effluent associated with traditional dyeing operations. Because the high temperatures used in the present invention, noxious dye assist chemicals such as carriers are not necessary. The process is also much less sensitive to fiber structure and properties than is conventional dyeing. Consequently the dying is extremely uniform.

The advantages of the present invention versus melt coloration include the dramatic reduction in waste yarn processed at start up and shut down. Furthermore the process is amenable to the use of the broad spectrum of conventional disperse dyes versus specially selected pigments. Conventional dyeing color matching technology can also be used circumventing the need for tedious color matching through master batch preparation.

The present invention is further illustrated by the following examples. These examples however, should not be construed as in any way limiting the present invention. All parts and percentages in the Examples in the remainder of the specification are by weight unless otherwise specified.

EXAMPLE 1

A 5% dispersion of commercial CI disperse blue 27 is metered onto a 265 denier PET POY threadline using a gear pump and a ceramic applicator immediately prior to a set off feed rolls. The wet filament is passed onto a set of ambient rolls at 25 mpm. From there it passes to a set of annealing rolls at 180° C.–240° C. as shown in Table 1. The speed of the annealing roll set is 50 mpm so that the POY is drawn 2:1. The residence time on the annealing rolls is from about 5.5 to about 8.25 seconds. A dark denim colored dyed fiber is wound up. Upon casual examination the dye appeared to be well fixed. However careful examination of the dyed yarn shows that it is ring dyed with a substantial quantity of "loose" dye still on the fiber surface. The loose dye could be removed mechanically or by rinsing with cold water.

TABLE 1

| | ANNEALING | | DYE | HEATING | | |
|---|---|---|---|---|---|---|
| EXPERIMENT | T°C. | Time (Sec.) | % of Fibers | T°C. | Time (Min.) | DYE Character |
| 1 (Control) | 210 | 5.5 | 6.6 | 100 | 15. | Ring |
| 2 (Control) | 210 | 5.5 | 6.6 | 100 | 60 | Ring |
| 3 (Control) | 210 | 5.5 | 6.6 | 100 | 420 | Ring |
| 4 (Control) | 210 | 5.5 | 6.6 | 130 | 15 | Ring |
| 5 (Control) | 210 | 5.5 | 6.6 | 160 | 15 | Partial |
| 6 | 210 | 8.25 | 6.6 | 160 | 60 | Full Cross Section |
| 7 | 210 | 8.25 | 3.3 | 160 | 420 | Full Cross Section |

The surface dyed yarn is then placed in a hot air oven for various periods of time and at various temperatures. It is observed that as the both time and temperature in the oven increase the fibers become progressively more uniform in cross section. After a period of 1 hour at 160°C. air temperature, the filaments have uniform cross sectional dyeing. Control experiments 1–5 were subjected to annealing plus insufficient heat drying resulting in ring dye. Experiments 6 and 7 were subjected to annealing plus heating temperatures for at least 1 hour in full cross section drying.

EXAMPLE 2

Commercial CI disperse blue 27 is applied by immersing a 90,000 filament 300,000 denier spun PET tow into a 3.5% dye dispersion at about 70° C. The saturated tow is then passed in a serpentine fashion through a set of 7 feed rolls heated to about 70° C. It is then drawn either 2.351:1 or 2.585:1 and passed through a nip onto another set of 14 rolls at 120 fpm. Tow moisture level after the nip is ~25%, giving a dye level of 0.88% dye on wt of fiber. The first 11 of the 14 draw rolls were heated to 75° C. and 200° C. to anneal the filaments as shown in Table 2. The last 3 were chilled. The residence time on the hot rolls is about 9.6 seconds.

The tow is then washed to remove loose surface dye and passed through a stuffer box crimper. A significant quantity of dye is washed off the fibers when the rolls are operated at 75° C. However when the rolls are run at 200° C. there is no visible dye wash off.

Following the crimping operation the tow is forwarded to a hot air drying oven. Residence time in the oven is 15 minutes. The oven is operated alternately at 60° C. and 175° C. When the dryer is at 60° C. the fibers are essentially ring dyed. However the 175° C. dried fibers show a full cross section dye. Surprisingly, changes in draw ratio had minimal effect on the depth of shade.

TABLE 2

| EXPERIMENT | DRAW RATIO | ANNEALING T°C. | HEATING T°C. | DYE Character |
|---|---|---|---|---|
| 1 | 2.35 | 75 | 175 | Full Cross Section |
| 2 | 2.585 | 75 | 175 | Full Cross Section |
| 3 (Control) | 2.585 | 200 | 60 | Ring |
| 4 (Control) | 2.35 | 200 | 60 | Ring |
| 5 | 2.585 | 200 | 175 | Full Cross Section |

EXAMPLE 3

A dispersion of commercial disperse dyes containing 0.044% CI Disperse yellow 64, 0.016% CI disperse red 60, and 0.001% CI Disperse Blue 56, is applied by super saturating a 750,000 filament 3,000,000 denier spun PET tow on a staple draw frame. The tow is fed to a set of 7 feed rolls operating at 115.7 fpm. The tow passes around the 7 rolls where a plurality of hydraulic sprays saturate it with dye liquor at 70° C. The tow is passed through a hip and around a series of draw and annealing rolls. The first of the draw rolls, equipped with a nip, is not heated. No measurable dyeing has occurred up to this point and the excess dye liquor from the nip can be returned to the spray system for recycling. Fifteen (15) subsequent rolls are heated to 196° C. All of the draw and annealing rollers operate at a speed of 450 fpm. Total residence time through the rollers is 6.9 seconds. The draw ratio is about 4:1.

Tow moisture level after the nip is about 25%, giving a dye level of 0.013% dye of weight of fiber. Total residence time on the hot rolls is approximately 7 seconds. After passing through the hot rolls moisture level is essentially zero and all of dye has been affixed to the surface of the fibers. The tow band is washed in a hydraulic spray but no dye is removed.

The tow is then passed through a steam crimper box to impart a three dimensional character to the fiber. No free dye is observed at the crimper. Since the overall level of dye and therefore dispersing agent were low, no processing problems were encountered.

After the crimping operation the tow is dried in a hot air oven at about 110° C. for about 15 minutes. The tow band then passes to a cutting and baling operation. A peach colored staple is produced with negligible extraneous surface deposition.

EXAMPLE 4

The process in example 3 is used to dye a PET tow using a 0.05% dispersion of pure CI disperse blue 165 formulated to contain a minimum of extraneous extra components. The dye formulation is:

| | |
|---|---|
| Dianix Blue GSL FW-F8 | 25.00% |
| Ethal NP-10f | 5.00% |
| HOE-S-3169 | 0.50% |
| Surfynol 104E | 1.00% |
| Proxel GXL | 0.25% |
| Kelzan S | 0.20% |
| Water | 68.05% |

Dianix is a trademark of Hoechst Celanese Corporation. Dianix Blue GSL FW-F8 dye and HOE-S-3169 dispersant are commercially available from Hoechst Celanese Corporation. Ethal is a trademark of Ethox Chemical and Ethal NP-10f dispersant is commercially available from Ethox Chemical. Surfynol is a trademark of Air Products and Surfynol 104E defoamer is commercially available from Air Products. Proxel is a trademark of ICI Americas and Proxel GXL biocide is commercially available therefrom. Kelzan is a trademark of Merch & Co. and Kelzan S thickener is available therefrom.

With this formulation, dye components account for 78% of the total solids addition while non-dye components account for only 22%. Neither the dye nor dispersants have a detectable impact on fiber down stream processing performance. Fibers of an attractive blue are obtained. No dye could be extracted by saline or methanol washes.

EXAMPLE 5

PET fibers are dyed with CI disperse red 364 using the same process as example 3. The dye, formulated to contain a minimum of extraneous extra components, is added to the drawing finish of a commercial staple drawframe at 0.01% pure dye on weight of fibers. The dye formulation is:

| | |
|---|---|
| Hostasol Red 5B | 15.00% |
| Ethal NP-10F | 3.75% |
| HOE-S-3169 | 0.95% |
| Surfynol 104E | 1.00% |
| Proxel GXL | 0.25% |
| Kelzan S | 0.20% |
| Propylene Glycol | 0.93% |
| Water | 78.05% |

Hostasol is a trademark of Hoechst Celanese Corporation and Hostasol red 5b dye is commercially available therefrom. The other names have been discussed in Example 4.

With this formulation, dye components account for 68% of the total solids addition while non dye components account for only 32%. Furthermore the additives are of low molecular weight, highly soluble and easily removed from the fibers. The yarn is drawn by the same process as example 3 onto heated rolls at 200° C. for about 6.5 seconds and reaches a mean temperature of 196° C. The tow band is washed in a hydraulic spray and then passed to a stuffer box crimping operation. No dye is removed by the sprays or in the crimping operation. The crimped fibers are then passed to a dryer where the fibers are subjected to temperatures of approximately 120° C. for about 15 minutes. Fibers of an attractive pink are obtained. The total dye process effluent from the production of 8000 lbs of dyed fiber was 180 gals with containing 0.14 lbs of pink dye.

Thus, it is apparent that there has been provided, in accordance with the invention, a process for dyeing melt spun synthetic filaments that fully satisfies the objects, aims and advantages as set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations that fall with the sphere and scope of the invention.

What is claimed:

1. A process for dyeing of melt spun synthetic filaments selected from the group consisting of poly(ethylene terephthalate), poly(trimethylene terephthalate), poly(tetramethylene terephthalate), copolymers thereof and polyamide consisting essentially of the steps of application of a disperse dye dispersed in water to said melt spun synthetic filaments resulting in surface dyed filaments; then drawing the surface dyed filaments forming drawn filaments; then annealing said drawn filaments at a temperature from about 180° C. to about 210° C. for an appropriate time to evaporate the water from the filament surface and to affix said dye to the surface of the filament forming surface dyed drawn filament wherein said annealing stabilizes said drawn filaments against shrinkage;

heat setting said surface dyed drawn filaments at a temperature of from about 110° C. to about 180°C. wherein said temperature and time are sufficient to uniformly diffuse the dye throughout the total cross-section of the drawn filament.

2. A process of claim 1 wherein said drawn filaments are annealed from about 190° C. to about 210° C. for about 5 seconds and heat set from about 160° C. to 180° C. for about 10 minutes.

* * * * *